US008656629B2

(12) United States Patent
Holmberg

(10) Patent No.: US 8,656,629 B2
(45) Date of Patent: Feb. 25, 2014

(54) RANGE FINDER FOR WEAPONS

(76) Inventor: Larry Holmberg, Gully, MN (US)

( * ) Notice: Subject to any disclaimer, the term of this patent is extended or adjusted under 35 U.S.C. 154(b) by 0 days.

(21) Appl. No.: 13/555,802

(22) Filed: Jul. 23, 2012

(65) Prior Publication Data

US 2013/0000177 A1 Jan. 3, 2013

Related U.S. Application Data

(63) Continuation of application No. 12/455,181, filed on May 29, 2009, now Pat. No. 8,240,077, which is a continuation-in-part of application No. 11/327,123, filed on Jan. 6, 2006, now Pat. No. 7,574,824, and a continuation-in-part of application No. 11/106,828, filed on Apr. 15, 2005, now Pat. No. 7,643,132, which is a continuation-in-part of application No. 11/018,960, filed on Dec. 21, 2004, now Pat. No. 7,100,321, which is a continuation of application No. 10/641,169, filed on Aug. 14, 2003, now Pat. No. 6,988,331, which is a continuation of application No. 10/090,333, filed on Mar. 4, 2002, now Pat. No. 6,615,531.

(51) Int. Cl.
*F41G 3/06* (2006.01)

(52) U.S. Cl.
USPC ..... 42/117; 33/265

(58) Field of Classification Search
USPC ..... 42/114, 117; 33/265
See application file for complete search history.

(56) References Cited

U.S. PATENT DOCUMENTS

| | | | |
|---|---|---|---|
| 521,761 | A | 6/1894 | Day |
| 547,912 | A | 10/1895 | Crupe |
| 619,214 | A | 2/1899 | Paul |
| 674,229 | A | 5/1901 | Windle |
| 845,165 | A | 2/1907 | Davis |
| 899,639 | A | 9/1908 | Vibber |
| 1,360,443 | A | 11/1920 | Robertson et al. |
| 1,452,651 | A | 4/1923 | Norrlin |
| 1,480,147 | A | 1/1924 | Brandt |
| 1,550,849 | A | 8/1925 | Szalardi |
| 1,735,164 | A | 11/1929 | Green |

(Continued)

FOREIGN PATENT DOCUMENTS

| | | | |
|---|---|---|---|
| CA | 2287748 | A1 | 10/1999 |
| CA | 2534805 | A1 | 1/2006 |

(Continued)

OTHER PUBLICATIONS

Improved Construction Methods, "Laser Measuring System, Impulse LX", http://www.improvedconstructionmethods.com/impulse_xl.htm, 2 pages.

(Continued)

*Primary Examiner* — Stephen M Johnson
(74) *Attorney, Agent, or Firm* — Kinney & Lange, P.A.

(57) ABSTRACT

A range finder includes housing, circuitry, a lens, a display, and a plurality of threaded apertures. The housing has a front end, a rear end, and a bottom portion extending between the front end and the rear end. The range finder circuitry is located within the housing. The lens is located at the front end of the housing. The display is located at the rear end of the housing. The plurality of threaded apertures are located in the bottom portion of the housing.

12 Claims, 17 Drawing Sheets

(56) References Cited

U.S. PATENT DOCUMENTS 1,757,244 A 5/1930 Green
1,923,926 A 8/1933 Faure-Roux
1,955,300 A 4/1934 Kurnick
2,072,387 A 3/1937 Sneed
2,101,479 A 12/1937 Schenk
2,129,606 A 9/1938 Nisenson
2,270,902 A 1/1942 Rubissow
2,282,680 A 5/1942 Sonne
2,296,308 A 9/1942 Rand
2,354,998 A 8/1944 Ku
2,416,769 A 3/1947 Palmer
2,450,466 A 10/1948 Carlson
2,456,554 A 12/1948 Churchill
2,483,711 A 10/1949 Roos
2,576,007 A 11/1951 Fischer et al.
2,604,933 A 7/1952 Karg
2,664,797 A 1/1954 Thrasher
2,814,118 A 11/1957 Evans et al.
2,817,233 A 12/1957 Dower et al.
2,911,894 A 11/1959 Henning et al.
2,943,547 A 7/1960 Martin
3,035,880 A 5/1962 Hitchcock
3,062,114 A 11/1962 Palos
3,065,666 A 11/1962 Sampson
3,078,728 A 2/1963 Schlesman
3,165,972 A 1/1965 Cumbo
3,371,899 A 3/1968 Johnson
3,427,102 A 2/1969 Wade
3,483,623 A 12/1969 Kruzell
3,484,317 A 12/1969 Dickerson
3,502,062 A 3/1970 Shurts
3,545,356 A 12/1970 Nielsen
3,684,376 A 8/1972 Lessard
3,684,378 A 8/1972 Lord
3,737,232 A 6/1973 Milburn, Jr.
3,782,822 A 1/1974 Spence
3,785,261 A 1/1974 Ganteaume
3,834,052 A 9/1974 Steck, III
3,945,134 A 3/1976 Ramer
3,986,285 A 10/1976 Krisay
4,000,403 A 12/1976 Rice
4,026,054 A 5/1977 Snyder
4,027,414 A 6/1977 Felix
4,069,414 A 1/1978 Bell
4,083,480 A 4/1978 Lee et al.
4,162,696 A 7/1979 Sprung
4,223,770 A 9/1980 Kranz
4,234,112 A 11/1980 Gallant
4,281,343 A 7/1981 Monteiro
4,283,743 A 8/1981 Kaiser
T101,001 I4 9/1981 Shipp et al.
D261,545 S 10/1981 Holmberg
4,296,725 A 10/1981 Broderick
4,309,095 A * 1/1982 Buckley ..... 396/420
4,312,580 A 1/1982 Schwomma et al.
4,316,342 A 2/1982 Griggs
4,349,169 A 9/1982 McAnally
D268,910 S 5/1983 Shipp et al.
4,439,032 A 3/1984 Congdon
4,485,398 A 11/1984 Chapin, Jr. et al.
4,485,407 A 11/1984 Bohm et al.
4,507,689 A 3/1985 Kozuki et al.
4,514,907 A 5/1985 Saltzman
4,516,296 A 5/1985 Sherman
4,531,052 A 7/1985 Moore
4,561,204 A 12/1985 Binion
4,564,322 A 1/1986 Stapley
4,578,708 A 3/1986 Munnion
4,597,211 A 7/1986 Miles
4,604,668 A 8/1986 Lemelson
4,606,629 A 8/1986 Hines et al.
4,617,741 A 10/1986 Bordeaux et al.
4,630,911 A 12/1986 Paul
4,640,258 A 2/1987 Penney et al.
4,643,159 A 2/1987 Ryan
4,699,484 A 10/1987 Howell et al.
4,730,190 A 3/1988 Win et al.
4,733,838 A 3/1988 van der Lely
4,753,528 A 6/1988 Hines et al.
4,761,888 A 8/1988 Kudlacek
4,777,352 A 10/1988 Moore
4,786,204 A 11/1988 Mayeda
4,786,966 A 11/1988 Hanson et al.
4,819,101 A 4/1989 Lemelson
4,827,348 A 5/1989 Ernest et al.
4,835,621 A 5/1989 Black
4,884,137 A 11/1989 Hanson et al.
4,890,128 A 12/1989 Kania
4,910,717 A 3/1990 Terry
4,920,654 A 5/1990 Sanders
4,939,863 A 7/1990 Alexander et al.
4,961,111 A 10/1990 Herlitz et al.
4,970,589 A 11/1990 Hanson et al.
4,974,575 A 12/1990 Mitchell
D313,361 S 1/1991 Robinson
4,989,024 A 1/1991 Myers
4,993,833 A 2/1991 Lorey et al.
4,996,866 A 3/1991 Masera et al.
5,005,213 A 4/1991 Hanson et al.
5,020,262 A 6/1991 Pena
5,026,158 A 6/1991 Golubic
5,033,219 A 7/1991 Johnson et al.
5,035,390 A 7/1991 Sanders
5,056,410 A 10/1991 Pitts
5,068,720 A 11/1991 Herlitz et al.
5,107,286 A 4/1992 Sergeant et al.
5,113,745 A 5/1992 Allen
5,115,263 A 5/1992 Bernhardt et al.
5,119,203 A 6/1992 Hosaka et al.
5,121,147 A 6/1992 Wada et al.
5,161,310 A 11/1992 Stoot
5,162,915 A 11/1992 Idera et al.
5,192,227 A 3/1993 Bales
5,200,827 A 4/1993 Hanson et al.
5,244,430 A 9/1993 Legursky
5,260,837 A 11/1993 Lemelson
5,262,837 A 11/1993 Shyy
5,265,896 A 11/1993 Kravitz
5,285,894 A 2/1994 Kamata et al.
5,287,133 A 2/1994 Bohley
5,287,644 A 2/1994 Bolduc
5,294,988 A 3/1994 Wakabayashi et al.
5,297,533 A 3/1994 Cook
5,305,030 A 4/1994 Yokoyama et al.
5,326,061 A 7/1994 Hamilton
5,339,793 A 8/1994 Findley
5,373,657 A 12/1994 Betz et al.
5,379,159 A 1/1995 Lemelson
5,418,609 A 5/1995 Dunne
5,419,072 A * 5/1995 Moore et al. ..... 42/117
5,446,599 A 8/1995 Lemelson
5,450,993 A 9/1995 Guerrero et al.
5,455,625 A 10/1995 Englander
5,456,157 A 10/1995 Lougheed et al.
5,469,271 A 11/1995 Hoshino et al.
5,479,712 A 1/1996 Hargrove et al.
5,491,464 A 2/1996 Carter et al.
5,491,546 A * 2/1996 Wascher et al. ..... 356/4.03
5,491,919 A 2/1996 Rather et al.
5,507,272 A 4/1996 Scantlen
5,517,683 A 5/1996 Collett et al.
5,520,164 A 5/1996 Huddleston
D371,084 S 6/1996 Ogawa
5,528,325 A 6/1996 Perez
5,531,149 A 7/1996 Schubert et al.
5,537,175 A 7/1996 Kamaya et al.
5,555,665 A 9/1996 Fore
5,575,072 A 11/1996 Eldridge
D378,047 S 2/1997 Chudoba
5,606,818 A 3/1997 Hardee
5,607,091 A 3/1997 Musacchia
5,610,580 A 3/1997 Lai
5,610,655 A 3/1997 Wakabayashi et al.
5,611,324 A 3/1997 Kursinsky

(56) References Cited

U.S. PATENT DOCUMENTS 5,615,854 A 4/1997 Nomura et al.
5,669,147 A 9/1997 Nakajima et al.
5,669,173 A 9/1997 Rodney, Jr.
5,669,174 A 9/1997 Teetzel
5,686,690 A 11/1997 Lougheed et al.
5,687,910 A 11/1997 King
5,694,169 A 12/1997 Noji
5,694,202 A 12/1997 Mladjan et al.
5,711,104 A 1/1998 Schmitz
D390,483 S 2/1998 Zykan et al.
5,732,912 A 3/1998 Nomura et al.
5,739,859 A 4/1998 Hattori et al.
5,742,859 A 4/1998 Acker
5,801,919 A 9/1998 Griencewic
5,811,720 A 9/1998 Quinnell et al.
5,815,251 A 9/1998 Ehbets et al.
5,822,621 A 10/1998 Szajewski
5,831,718 A 11/1998 Desai et al.
5,834,676 A 11/1998 Elliott
5,835,807 A 11/1998 Brock
5,845,165 A 12/1998 McMahan
5,859,693 A 1/1999 Dunne et al.
5,867,930 A * 2/1999 Kaminski et al. ..... 42/70.11
5,887,375 A 3/1999 Watson
5,892,617 A 4/1999 Wallace
5,895,131 A 4/1999 Yano
5,911,215 A 6/1999 Fisher, Jr.
5,926,260 A 7/1999 Dunne et al.
5,927,041 A 7/1999 Sdelmeier et al.
5,937,562 A 8/1999 Brough
5,941,434 A 8/1999 Green
5,944,041 A 8/1999 Kitchens
5,949,529 A 9/1999 Dunne et al.
5,963,748 A 10/1999 Glasson
5,964,054 A 10/1999 Galfidi, Jr.
5,973,315 A 10/1999 Saldana et al.
6,000,163 A 12/1999 Gordon
D421,229 S 2/2000 Imai
6,029,643 A 2/2000 Golfieri
6,070,355 A 6/2000 Day
6,073,352 A 6/2000 Zykan et al.
D432,930 S 10/2000 Sanoner
6,134,793 A * 10/2000 Sauers ..... 33/265
6,137,564 A 10/2000 Schmidt et al.
6,145,230 A 11/2000 Holmberg
6,154,971 A * 12/2000 Perkins ..... 33/265
6,155,601 A 12/2000 Cantor et al.
6,192,614 B1 2/2001 Cliburn
6,252,706 B1 6/2001 Kaladgew
6,269,581 B1 8/2001 Groh
6,286,796 B1 9/2001 Pugliesi
6,288,386 B1 9/2001 Bowen et al.
6,296,581 B1 10/2001 Sever
6,304,289 B1 10/2001 Sakai et al.
6,331,887 B1 12/2001 Shiraishi et al.
6,336,285 B1 1/2002 Baumer
6,341,201 B1 1/2002 Ishiguro et al.
6,363,648 B1 4/2002 Kranich et al.
6,396,571 B2 5/2002 Ohtomo et al.
6,397,483 B1 6/2002 Perkins
6,398,571 B1 6/2002 Nishide et al.
6,408,140 B1 6/2002 Malloy Desormeaux
D460,367 S 7/2002 Apotheloz et al.
D460,368 S 7/2002 Apotheloz et al.
D460,369 S 7/2002 Apotheloz et al.
6,425,697 B1 7/2002 Potts et al.
6,450,816 B1 9/2002 Gerber
6,487,809 B1 12/2002 Gaber
6,494,196 B2 12/2002 Harwath et al.
6,494,368 B2 12/2002 Sapia
6,526,956 B1 3/2003 Hankins
D472,826 S 4/2003 Sanoner
6,556,245 B1 4/2003 Holmberg
6,598,331 B1 7/2003 Thibodeaux
6,615,531 B1 9/2003 Holmberg
6,623,182 B2 9/2003 Tatera
6,624,881 B2 9/2003 Waibel et al.
6,678,988 B1 1/2004 Poff, Jr.
6,681,755 B2 1/2004 Pujos
6,693,702 B2 2/2004 Rogers
6,704,097 B2 3/2004 Waibel et al.
D488,315 S 4/2004 Natuzzi
6,722,076 B2 4/2004 Nielsen
6,742,299 B2 6/2004 Strand
6,772,076 B2 8/2004 Yamamoto et al.
6,784,920 B2 8/2004 Weber
6,796,038 B2 9/2004 Humphries
6,813,025 B2 11/2004 Edwards
6,815,251 B1 11/2004 Akram et al.
6,819,495 B2 11/2004 Shani et al.
6,819,866 B2 11/2004 Da Silva
6,886,287 B1 5/2005 Bell et al.
6,886,288 B1 5/2005 Yocum et al.
6,932,305 B2 8/2005 Morales et al.
6,988,331 B2 1/2006 Holmberg
7,002,620 B1 2/2006 Rutledge
7,006,144 B2 2/2006 Holmberg
7,088,506 B2 8/2006 Regan et al.
7,100,321 B2 9/2006 Holmberg
7,128,354 B2 10/2006 Wu
7,173,804 B2 2/2007 Radhakrishnan et al.
7,188,978 B2 3/2007 Sharrah et al.
7,206,024 B2 4/2007 Tsukahara et al.
7,255,035 B2 8/2007 Mowers
7,269,920 B2 9/2007 Staley, III
7,280,192 B2 10/2007 Hayashi et al.
7,327,394 B2 2/2008 Holmberg
7,371,021 B2 5/2008 Ross, Jr. et al.
7,390,130 B2 6/2008 Soulvie
7,394,528 B2 7/2008 Hinchliff et al.
7,505,248 B2 3/2009 Mehr et al.
7,506,643 B2 3/2009 Holmberg
7,594,352 B2 9/2009 Holmberg
7,614,805 B2 11/2009 Showalter
7,789,574 B2 9/2010 Broberg
2001/0018311 A1 8/2001 Musacchia
2001/0035440 A1 11/2001 Danielson
2002/0067475 A1 6/2002 Waibel et al.
2002/0071050 A1 6/2002 Holmberg
2002/0078577 A1 6/2002 Aldred
2002/0087475 A1 7/2002 Okayama et al.
2002/0109057 A1 8/2002 Wooten et al.
2002/0163588 A1 11/2002 Holmberg
2002/0167606 A1 11/2002 Holmberg
2002/0171755 A1 11/2002 Nishimura
2003/0013392 A1 1/2003 Guillermin
2003/0133092 A1 7/2003 Rogers
2003/0163943 A1 9/2003 Holmberg
2003/0168484 A1 9/2003 Gates et al.
2004/0000083 A1 1/2004 Grant, Jr.
2004/0016169 A1 1/2004 Poff, Jr.
2004/0051865 A1 3/2004 Stierle et al.
2004/0079018 A1 4/2004 Holmberg
2004/0114129 A1 6/2004 Gogolla et al.
2004/0135991 A1 7/2004 Gogolla et al.
2004/0183942 A1 9/2004 Holmberg
2004/0194364 A1 10/2004 Holmberg
2004/0257437 A1 12/2004 Lesseu
2005/0035245 A1 2/2005 Morales et al.
2005/0115141 A1 6/2005 Holmberg
2005/0123883 A1 6/2005 Kennen et al.
2005/0195385 A1 9/2005 Holmberg
2005/0198885 A1 9/2005 Staley, III
2005/0241210 A1 11/2005 Karcher et al.
2005/0246910 A1 11/2005 Mowers
2005/0252062 A1 11/2005 Scrogin et al.
2005/0268519 A1 12/2005 Pikielny
2005/0268521 A1 12/2005 Cox et al.
2006/0010761 A1 1/2006 Staley, III

(56) References Cited

U.S. PATENT DOCUMENTS

| | | | |
|---|---|---|---|
| 2006/0067030 | A1 | 3/2006 | Radhakrishnan et al. |
| 2006/0215149 | A1 | 9/2006 | LaBelle et al. |
| 2006/0254116 | A1 | 11/2006 | Holmberg |
| 2007/0002520 | A1 | 1/2007 | Mehr et al. |
| 2007/0008187 | A1 | 1/2007 | Schmidt |
| 2007/0031142 | A1 | 2/2007 | Moody et al. |
| 2007/0068018 | A1 | 3/2007 | Gilmore |
| 2007/0081817 | A1 | 4/2007 | Soulvie |
| 2007/0125930 | A1 | 6/2007 | Tsai |
| 2007/0130848 | A1 | 6/2007 | Tsai |
| 2007/0157502 | A1 | 7/2007 | Holmberg |
| 2007/0157503 | A1 | 7/2007 | Holmberg |
| 2007/0186459 | A1 | 8/2007 | Horton |
| 2007/0277421 | A1 | 12/2007 | Perkins et al. |
| 2008/0000463 | A1 | 1/2008 | Holmberg |
| 2008/0000465 | A1 | 1/2008 | Holmberg |
| 2008/0001057 | A1 | 1/2008 | Holmberg |
| 2008/0060248 | A1 | 3/2008 | Pine et al. |
| 2008/0087784 | A1 | 4/2008 | Holmberg |
| 2008/0092421 | A1 | 4/2008 | Beckmann |
| 2008/0164392 | A1 | 7/2008 | Holmberg |

FOREIGN PATENT DOCUMENTS

| | | | |
|---|---|---|---|
| DE | 29608688 | U1 | 8/1996 |
| EP | 1804017 | A1 | 7/2007 |
| FR | 2369586 | A1 | 5/1978 |
| GB | 2024558 | A | 1/1980 |
| GB | 2114770 | A | 8/1983 |
| JP | 099117 | A | 1/1997 |
| JP | 09203944 | A | 8/1997 |
| JP | 10145653 | A | 5/1998 |
| WO | WO9012330 | | 10/1990 |
| WO | 9417444 | | 8/1994 |
| WO | WO2006090356 | A1 | 8/2006 |
| WO | WO2006133029 | A1 | 12/2006 |

OTHER PUBLICATIONS

"Specification Sheet on the Impulse 200 LR Laser (Rangefinder)," Nov. 15, 2003, Publisher: Laser Technology Inc., 2 pages.

Anderson et al., "Thermal Weapon Sight (TWS) AN-PAS-13 Diffractive Optics Designed for Producibility," Conf. on Binary Optics 1993.

Gilstrap et al., "Integrated Sight Boresighting," Mar. 1998.

* cited by examiner

RANGE FINDER FOR WEAPONS

CROSS-REFERENCE TO RELATED APPLICATION(S)

The present application is a continuation of U.S. patent application Ser. No. 12/455,181, filed May 29, 2009, now U.S. Pat. No. 8,240,077 and titled "RANGE FINDER FOR WEAPONS", which is a continuation-in-part of U.S. patent application Ser. No. 11/327,123, filed Jan. 6, 2006 and titled "DEVICE MOUNT FOR A FIREARM", now U.S. Pat. No. 7,574,824. Application Ser. No. 12/455,181 is also a continuation-in-part of application Ser. No. 11/106,828, filed Apr. 15, 2005 and titled "RANGE FINDER", now U.S. Pat. No. 7,643,132, which is a continuation-in-part of application Ser. No. 11/018,960, filed Dec. 21, 2004 and titled "RANGE FINDER", now U.S. Pat. No. 7,100,321. Further, application Ser. No. 11/018,960 is a continuation of application Ser. No. 10/641,169, filed Aug. 14, 2003 and titled "RANGE FINDER", now U.S. Pat. No. 6,988,331, which is a continuation of application Ser. No. 10/090,333, filed Mar. 4, 2002 and titled "RANGE FINDER", now U.S. Pat. No. 6,615,531.

BACKGROUND

Range finders can be a useful tool when hunting for game. A ranger finder conveys the distance to an object (game target). This information is helpful to a hunter because it allows a hunter to determine if the target is beyond the range of a firearm or bow. Knowing the distance to a target also aids the hunter in the placement of the sight of the firearm or bow. For example, if the target is a great distance from a firearm, a hunter can raise the sight of the firearm over the target a select distance to compensate for the trajectory of a projectile (bullet) fired from the firearm. The distance found by the range finder can aid the hunter in determining how much the sight should be raised over the target.

SUMMARY

An embodiment of the present invention is an optical range finder which includes housing, circuitry, a lens, a display, and a plurality of threaded apertures. The housing has a front end, a rear end, and a bottom portion extending between the front end and the rear end. The range finder circuitry is located within the housing. The lens is located at the front end of the housing. The display is located at the rear end of the housing. The plurality of threaded apertures are located in the bottom portion of the housing.

In another embodiment, the range finder includes housing, a signal lens, a liquid crystal display, a range finder circuit, and at least one threaded aperture. The housing includes a front end, a back end, a top, a bottom, a left side and a right side. The signal lens for projects and receives range finding signals. The signal lens is mounted at the front end of the housing. The liquid crystal display displays the distance measured by the range finding signals. The liquid crystal display is mounted at the back end of the housing. The range finder circuit is located within the housing between the signal lens and the display. At least one threaded attaching aperture extends upwards into the rangefinder from the bottom to attach the range finder to a weapon mount.

BRIEF DESCRIPTION OF THE DRAWINGS

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide a mount that allows for the attachment of a device such as a video camera, rangefinder or the like, to a weapon. In particular, in one embodiment, the mount allows the device to be mounted to a scope of a weapon in a manner that does not hamper the operation of the scope (i.e. the elevation and/or windage adjustment knob for example) or other operations of the weapon. In another embodiment, a mounting rail adapted to mount a device to a firearm. In yet another embodiment, a rangefinder having a remote port and attaching treads that can be attached to the mount is provided.

Figure 1A:
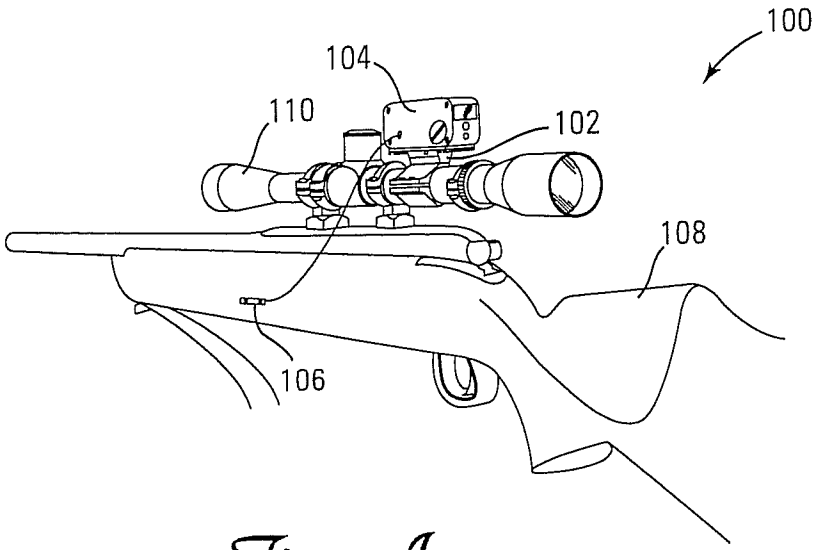
FIG. 1A is a side view of a mounting system of one embodiment of the present invention.
Figure 1B:
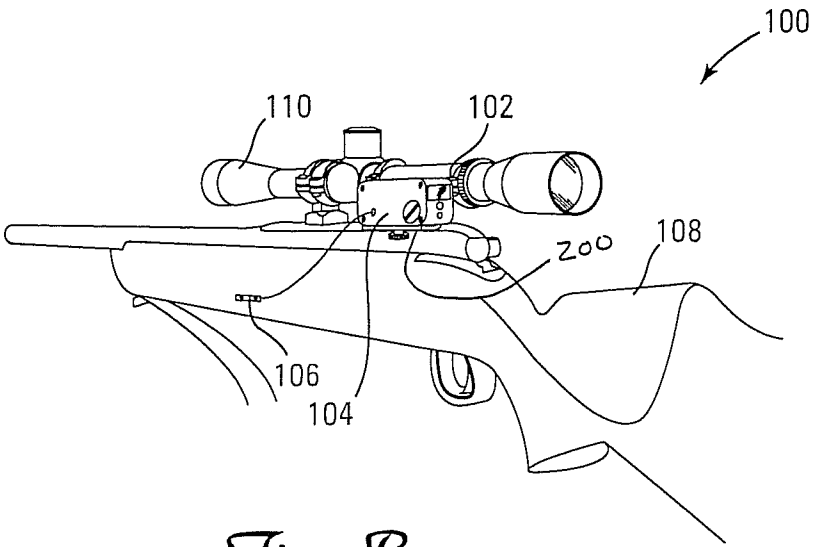
FIG. 1B is a side view of a mounting system of another embodiment of the present invention.

Referring to FIG. 1A, a mounting system 100 of one embodiment of the present invention is illustrated. The mounting system 100 in this embodiment includes a scope 110 that is mounted on a weapon, which is a rifle 108 in this example, and a scope mount 102. The electronic device is a rangefinder 104 in this example that can be operated remotely with a remote control pad 106. In the example of FIG. 1A, the rangefinder 104 is mounted over the scope 110 from a perspective of the hunter. Referring to FIG. 1B, an example of another embodiment in which the rangefinder 104 is mounted on the side of the scope 110 from the perspective of the hunter.

Figure 2B:
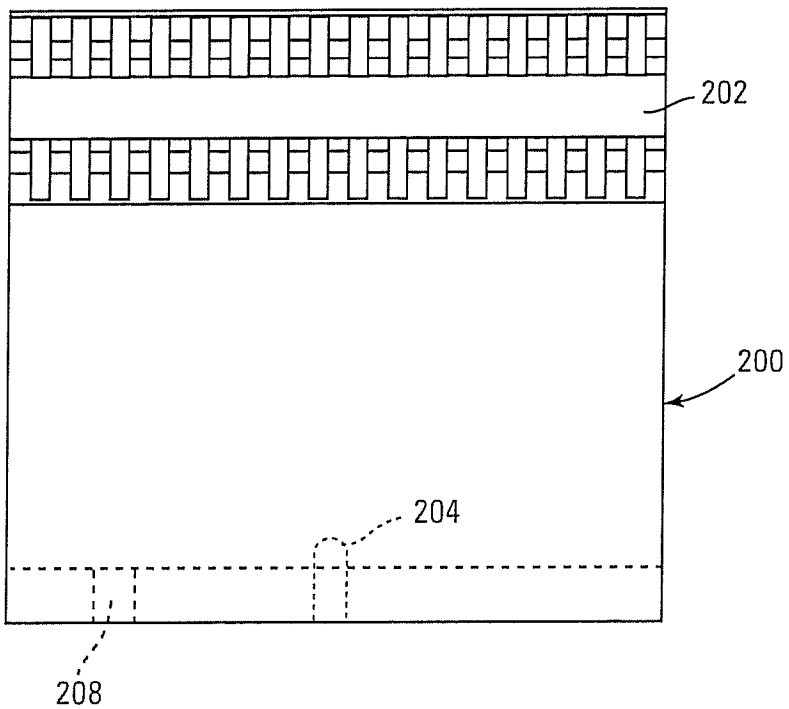
FIG. 2B is a back view of the mount of FIG. 2A illustrating a mounting rail of one embodiment of the present invention.
Figure 2A:
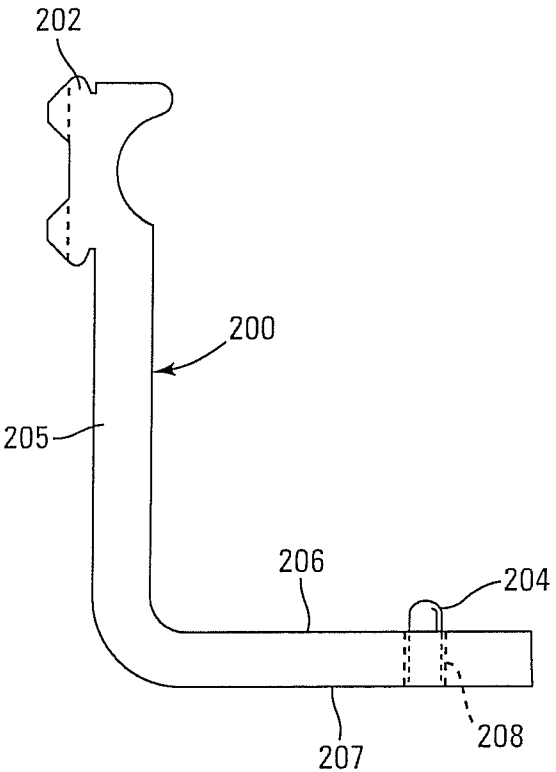
FIG. 2A is a side view of a mount of one embodiment of the present invention.
Figure 2C:
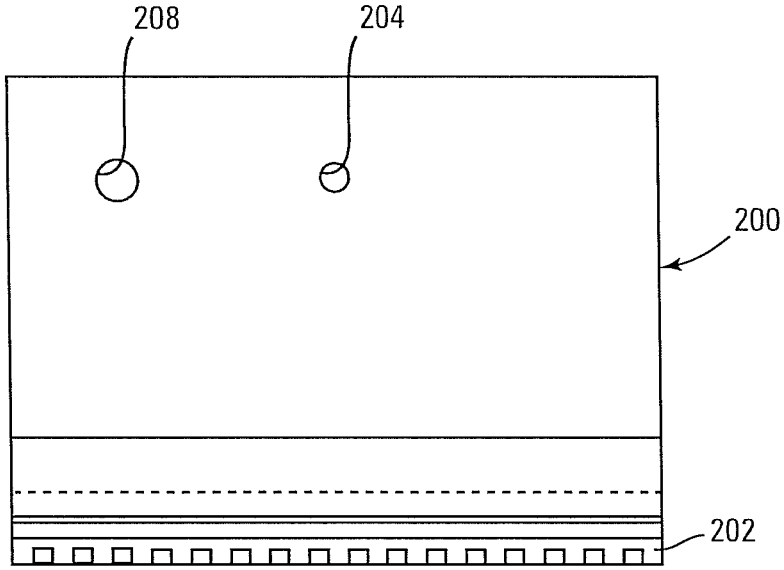
FIG. 2C is a top view of the mount of FIG. 2A.

FIG. 2A is a side view of a mount 200 of one embodiment of the present invention. The mount is used in embodiments of the present invention to mount a device to the weapon. The mount 200 includes a side plate 205 and a support plate 207 that generally makes the shape of an L. In particular, the support plate 207 extends from a first end of the side plate 205 at generally a right angle. The support plate 207 includes an engaging surface 206 to support a device and a stabilizing nub 204 designed to fit into a cavity of a device to provide stability and prevent the rotation of the device when mounted to the mount 200. The support plate 207 also includes a mounting aperture 208. The mounting aperture 208 is designed to allow a thumb screw (or any type of attaching device) to engage the device so that the device can be selectively coupled to the engaging surface 206 of the mount 200. The side plate 205 includes a mounting rail (or rail mount) 202 that is located near a second end of the side plate 205 that is opposite the first end of the side plate 205. As illustrated, the mounting rail 202 extends from the side plate 205 in a direction that is opposite the direction the support plate 207 extends from the side plate 205. FIG. 2B illustrates a back view of the mount 200 and in particular the mounting rail 202. FIG. 2C illustrates a top view of the mount 200 and in particular the stabilizing pin 204 and the mounting aperture 208.

Figure 3A:
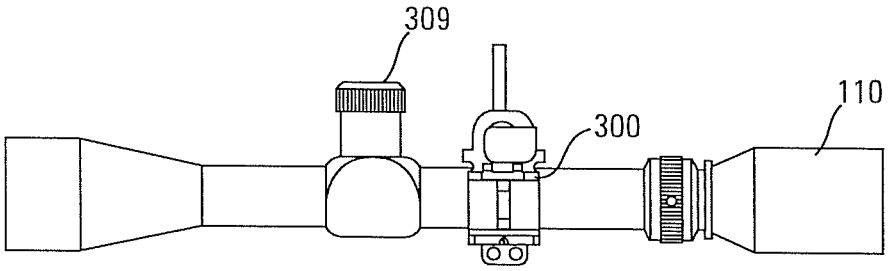
FIG. 3A is a side view of a scope mount with a locking rod mechanism.
Figure 3B:
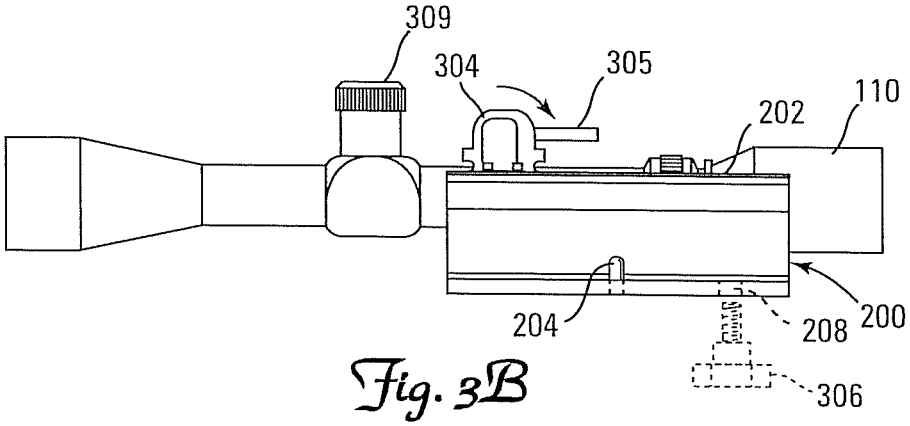
FIG. 3B is a side view of a scope mount engaging a mount of one embodiment of the present invention.
Figure 3C:
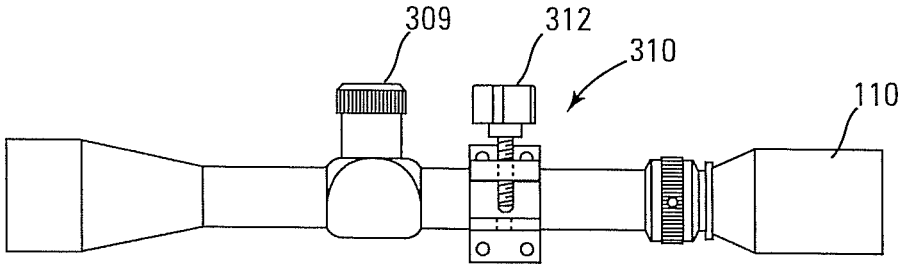
FIG. 3C is a side view of a scope mount with a thumb screw locking mechanism.

FIG. 3A illustrates a side view of a scope 110 with a quick mount scope mount 300 attached thereto. Also illustrated is the adjustment knob 304 of the scope 300 which adjusts the elevation and/or windage of the scope. It is important that the mount 200 and the device using the mount not interfere with the operations of the scope such as the operation of the adjustment knob 304. FIG. 3B illustrates a mount 200 coupled to the scope 110 via the scope mount 300. In particular, the scope mount 300 engages the mounting rail 202 of mount 200. In this embodiment, the scope mount 300 locks the mount onto the scope via a locking mechanism having a locking rod 305 that is rotated into a locking position. In the embodiment of FIG. 3C, a scope mount 310 of one embodiment of the present invention is illustrated. The scope mount 310 includes a threaded thumb screw 312 with a triangle shaped head. The triangle shaped head allows for the applying of a twisting pressure to selectively lock and unlock the scope mount 312 to the scope 110 without the use of a screwdriver.

Figure 4:
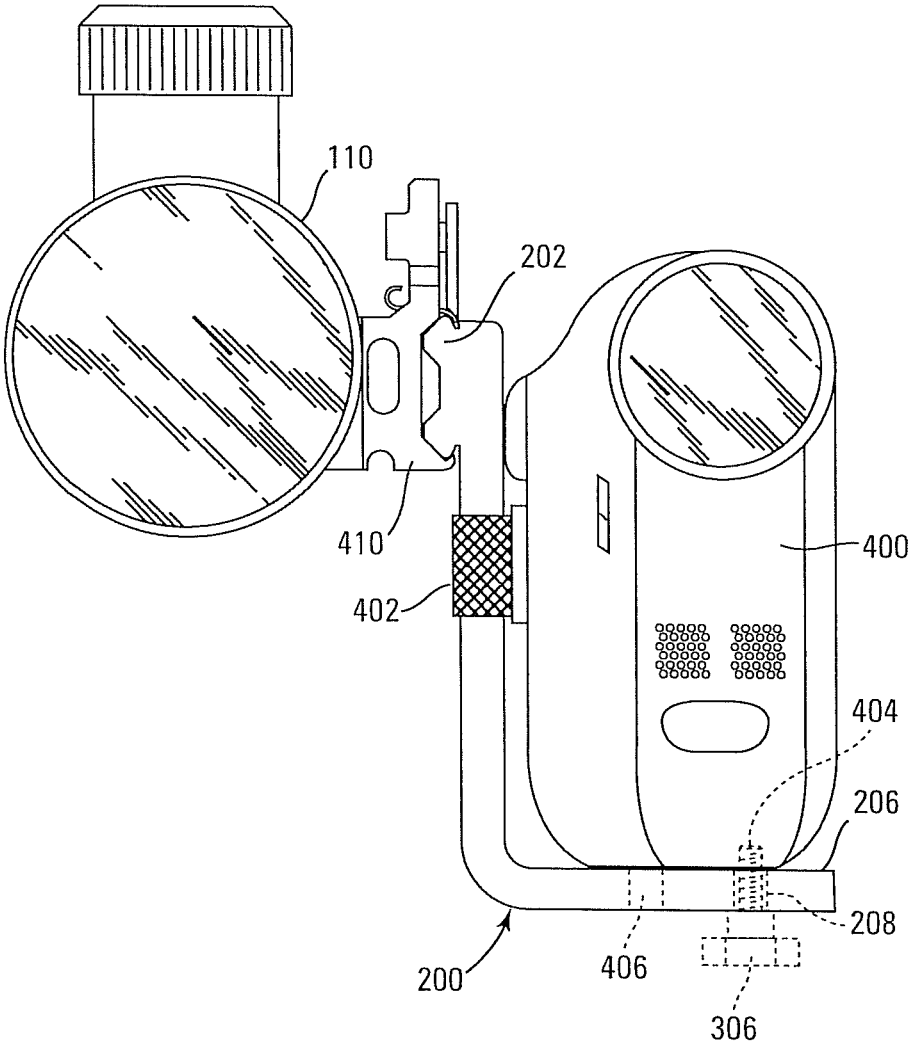
FIG. 4 is a front view of a mount of FIG. 2A attaching a camera to a scope.
Figure 5:
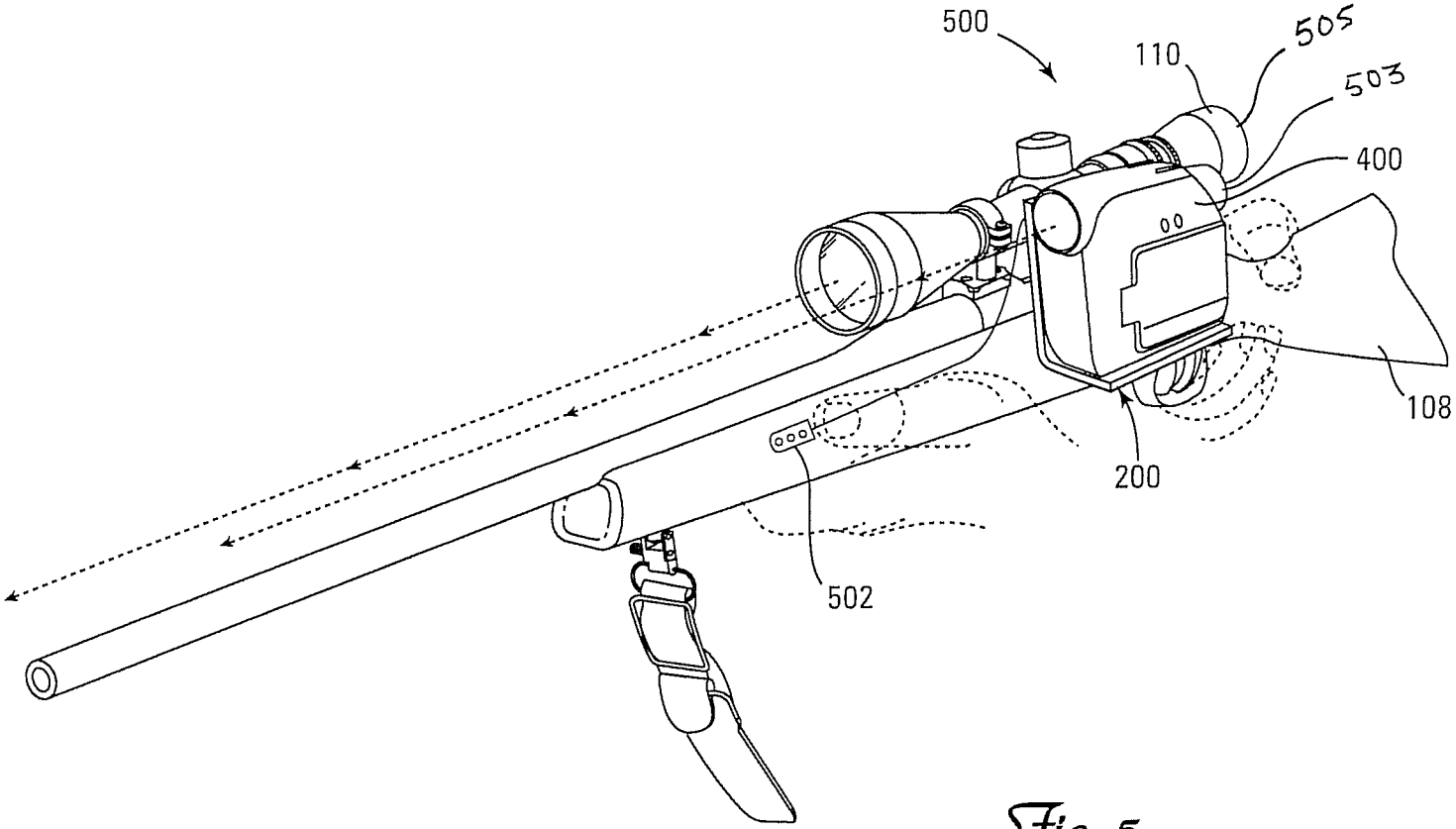
FIG. 5 is a side view of a mount of FIG. 2A attaching a camera to a rifle.

Referring to FIG. 4, a front view of the mount 200 attaching a video camera 400 to a scope 110 of one embodiment of the present invention is illustrated. As illustrated, a bottom side of camera 400 is positioned to abut the engaging surface 206 of the mount 200. The thumb screw mounting aperture 208 allows a triangular shaped head thumb screw 306 to be threaded into internal threads 404 of the camera 400 to secure the camera to the mount 200. Moreover, a hand strap 402 of the camera 400 can be wrapped around the mount as illustrated to further secure the camera to the mount 200. FIG. 4 further illustrates how the mounting rail 202 of the mount 200 is engaged with the scope mount 410. FIG. 5 illustrates the mounting system 500 on a rifle 108. As illustrated, the mount 20 allows for the camera to be mounted away from the elevation adjustment knob 309 of the scope 110. Moreover, as illustrated the eyepiece 503 of camera 400 is approximately at the same height as the eyepiece 505 of the scope 110 in relation to the hunter. That is, the eyepiece 503 of the camera 400 is basically at eye level with the aiming mechanism of the firearm. Accordingly, the hunter's movement to look between the scope and the view finder on the camera is minimal to avoid disruption of the hunt. This also applies to other devices such as a rangefinder with a display that is positioned relatively at eye level with the scope as illustrated in FIG. 1B. Also illustrated in FIG. 5 is a remote control pad 502 that is designed to control the camera 400.

Figure 6:
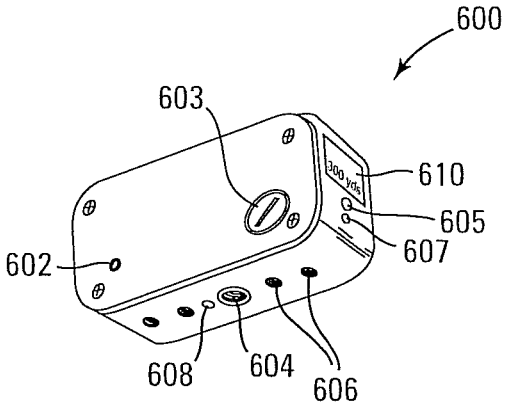
FIG. 6 is a side perspective view of a rangefinder of one embodiment of the present invention.

An example of a rangefinder 600 of one embodiment of the present invention is illustrated in FIG. 6. Rangefinder 600 includes attaching threads 604 adapted to engage the threads of a thumb screw. Accordingly, the rangefinder can be attached to the mounting plate 200 similar to the camera 400 of FIG. 4. This embodiment is illustrated in FIG. 1B. The rangefinder 600 also includes display 610, a power button 605, a mode switch button 607, a battery cover 603 and a remote control port 602 that allows for the remote operation of the rangefinder 600. Moreover, the bottom surface of the rangefinder 600 further includes 606 attaching apertures 606. The attaching apertures 606 are used to mount a mounting rail to the rangefinder 600. The bottom surface of the rangefinder 600 further includes a stabilizing recess 608 that is designed to receive a stabilizing nub such as the stabilizing nub 204 on mount 200. In this embodiment, the battery cover 603 and the remote control port 602 are positioned on a left side of the rangefinder 600 so that when the rangefinder 600 is mounted to a mount 200 as illustrated in FIG. 1B, the battery compartment and the port 602 are assessable. In another embodiment, where the mount 200 is mounted to the other side of the scope 110, the battery cover 603 and the remote control port 602 are positioned on a right side of the rangefinder 600 to allow access to the battery chamber and the port 602 when mounted to the mount 200 in this embodiment. In addition, as illustrated in FIG. 1B, the placement of the power button 605 and mode switch button 607 on a rear side of the rangefinder 600 allows for the ease of operation of the rangefinder 600 while the firearm is shouldered in a shooting position.

Figure 7A:
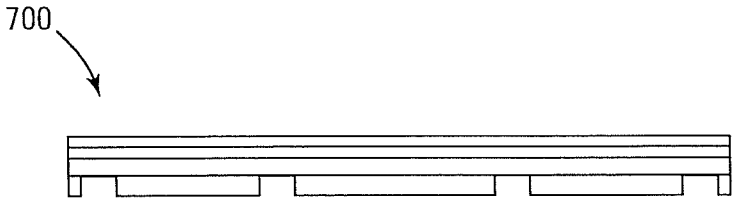
FIG. 7A is a side view of a mounting rail of one embodiment of the present invention.
Figure 7B:
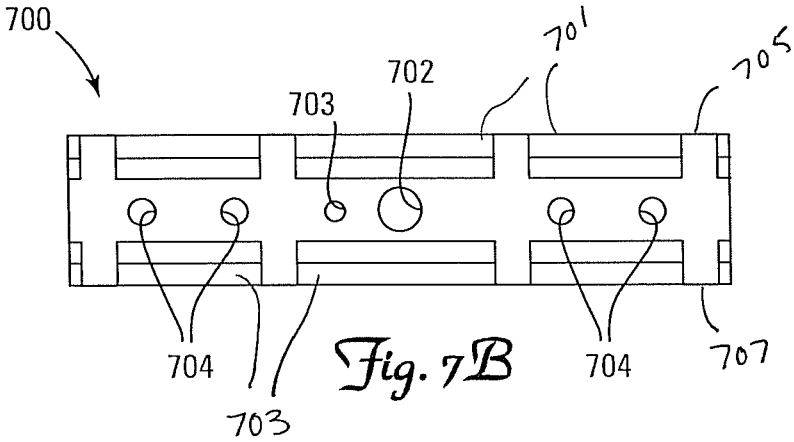
FIG. 7B is a top view of the mounting rail of FIG. 7A.

An example of a mounting rail 700 of one embodiment of the present invention is illustrated in FIGS. 7A and 7B. The mounting rail 700 of this embodiment includes rail apertures 704 that are adapted to be aligned with the attaching apertures of the rangefinder 606 of other device. Screws or other attachment means are used to secure the rangefinder 606 to the mounting rail 700 through the rail apertures 704 and the associated attaching apertures 606. Further illustrated is a stabilizing recess 703. This stabilizing recess is also designed to receive a stabilizing nub such as the stabilizing nub 204 on mount 200. The rail apertures 704, stabilizing nub as well as a rail thumb screw aperture 702 are positioned between a first edge 075 and a second edge 707 of the mounting rail 700. Moreover as illustrated, a first rail 701 is positioned along the first edge 705 and a second rail 703 is positioned along a second edge 707 of the mounting rail 700.

Figure 8:
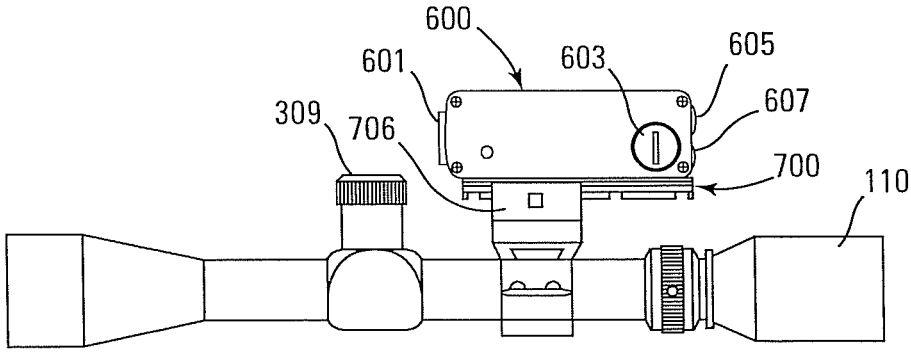
FIG. 8 is a side view of a rangefinder being attached to a scope of one embodiment of the present invention.
Figure 9:
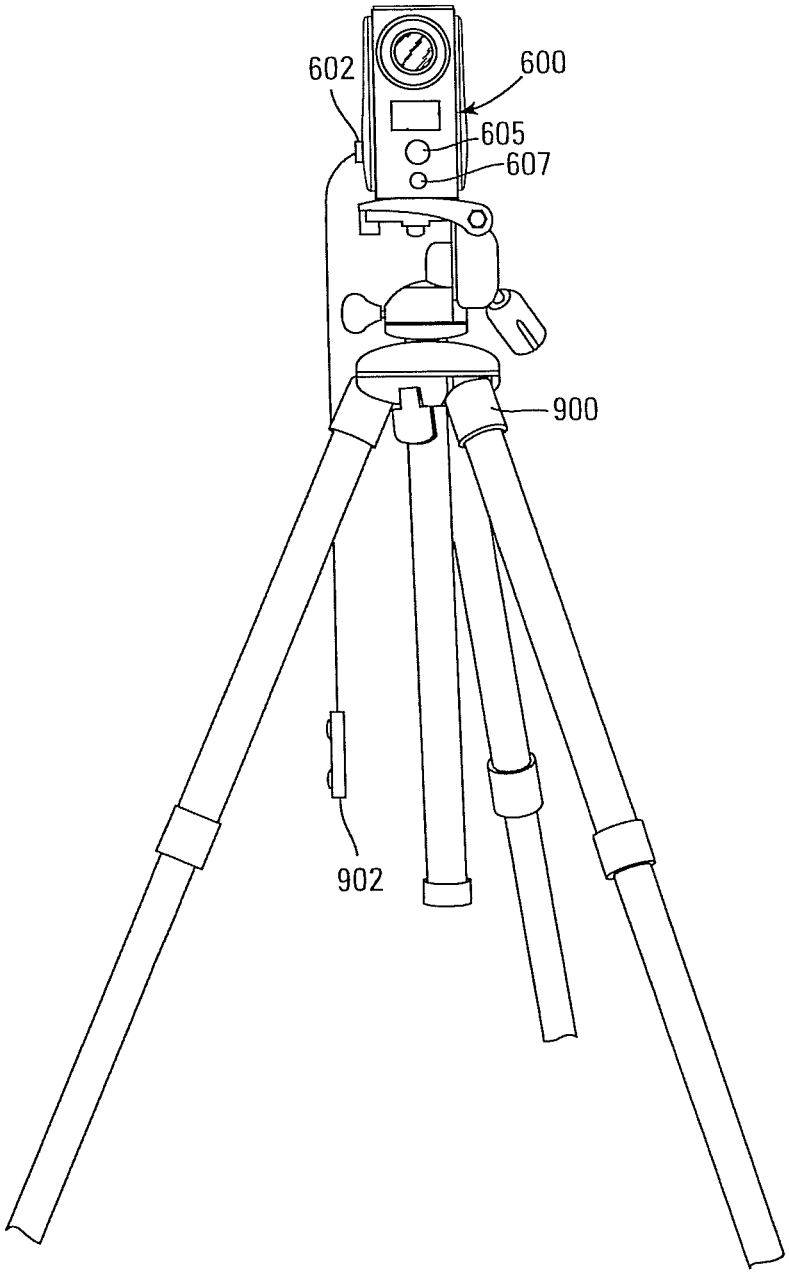
FIG. 9 is a front view of the rangefinder of FIG. 6 attached to a tripod.

An illustration of a rangefinder attached to a scope 110 using the mounting rail 700 and a scope mount 706 is illustrated in FIG. 8. As illustrated in this embodiment, the mounting rail 700 is directly coupled to the scope mount 706. In other embodiments, the mounting rail 700 is coupled to a mount 200 that is coupled to the scope mount 706. In these embodiments, the mount rail thumb screw aperture 702 is used to connect the mounting rail 700 and rangefinder 600 to the mount 200 via a thumb screw. The attaching threads 604 of the rangefinder 600 can also be used to mount the rangefinder 600 to a tripod 900 as illustrated in FIG. 9. As also illustrated in FIG. 9, the rangefinder 600 can be remotely operated by a remote control pad 902 that is in communication with the remote control port 602.

Figure 10:
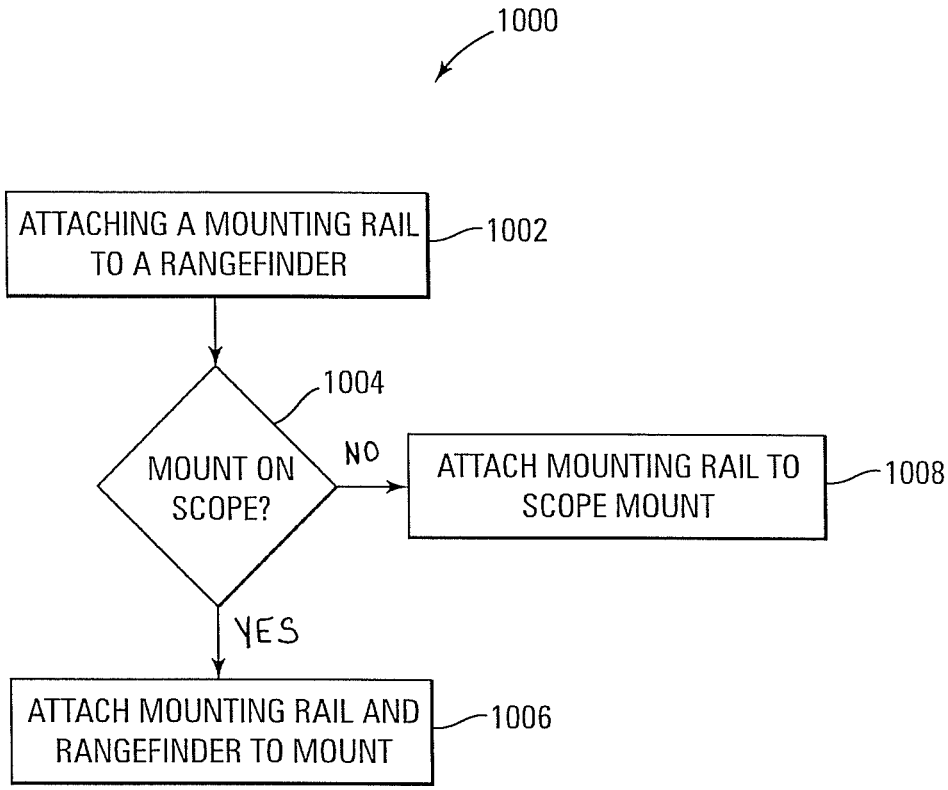
FIG. 10 is a flow diagram of one embodiment of the present invention.

One method of using a rangefinder 600 and a mount rail (or mounting rail) 700 of one embodiment of the present invention is illustrated in FIG. 10. As illustrated, the method begins by attaching a mounting rail 700 to the rangefinder 600 (1102). In one embodiment, as illustrated in FIGS. 6 and 8 the attachment is at the bottom of the rangefinder. This illustration however, is shown by way of example and not by limitation. Accordingly, the location of the attachment of the mounting rail 700 is not limited to the bottom of the rangefinder. It is then determined if a mount 200 is already on the scope (1004). If a mount 200 is not on the scope (1004), the mounting rail 700 is directly attached to a scope mount 706 as illustrated in FIG. 8. If a mount 200 is already on the scope (1004), the rangefinder 600 is attached to the mount 200 as illustrated in FIG. 1B.

Figure 11:
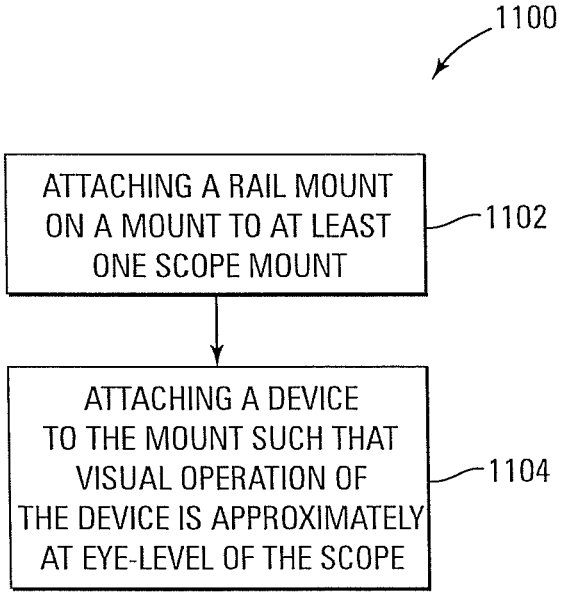
FIG. 11 is another flow diagram of another embodiment of the present invention.

As discussed above, the mount 200 can be used by a plurality of devices. One method of using the mount with devices in one embodiment of the present invention is illustrated in FIG. 11. As illustrated, a rail mount 202 on the mount 200 is first attached to at least one scope mount 304 (1101). This is illustrated in FIG. 3B. The device is then attached to the mount (1104). In one embodiment, the visual operation of the device is positioned by the mount to be at eye level with an aiming mechanism of the firearm which is in this embodiment, an eye piece of the scope. For example, as discussed above, with a video camera device 400 (of FIG. 5), the eyepiece 503 of the camera 400 is positioned approximately at eye level with the eyepiece 505 of the scope 110 and with the rangefinder example the display on the range finder is positioned approximately at eye level with the eyepiece of the scope (FIG. 1B).

Figure 12:
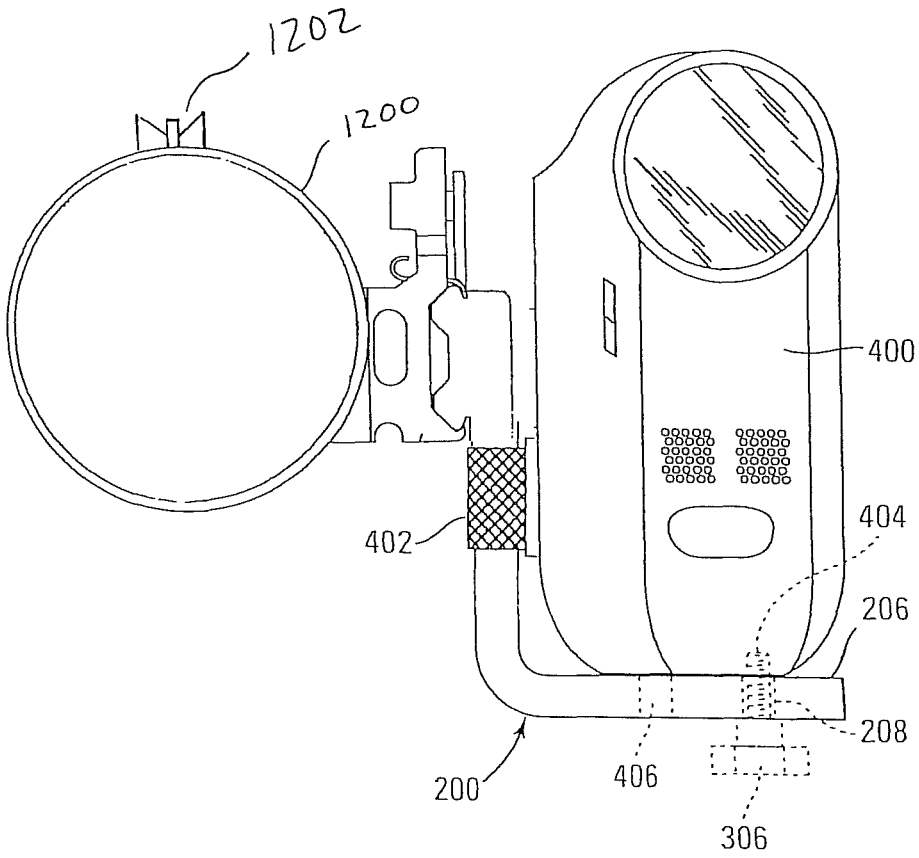
FIG. 12 is a front view of a mount of one embodiment of the present invention mounted to a barrel of a firearm.

Although, the above examples of the embodiments of the present invention illustrate a device being coupled to a scope of a firearm, other embodiments attach the device directly to a barrel of a firearm. For example, please refer to FIG. 12. In the embodiment of FIG. 12, a mount 200 is coupled directly to a barrel 1200 of a firearm via scope mount 410. That is, in this embodiment, the scope mount 410 is directly coupled to the barrel 1200 and not a scope. Also illustrated in FIG. 12 is the aiming mechanism 1210 of the firearm which is, in this embodiment, approximately at eye level with the operating device of the video camera 400. Accordingly, the above embodiments of the present invention are not limited to being mounted to a scope.

Figure 13:
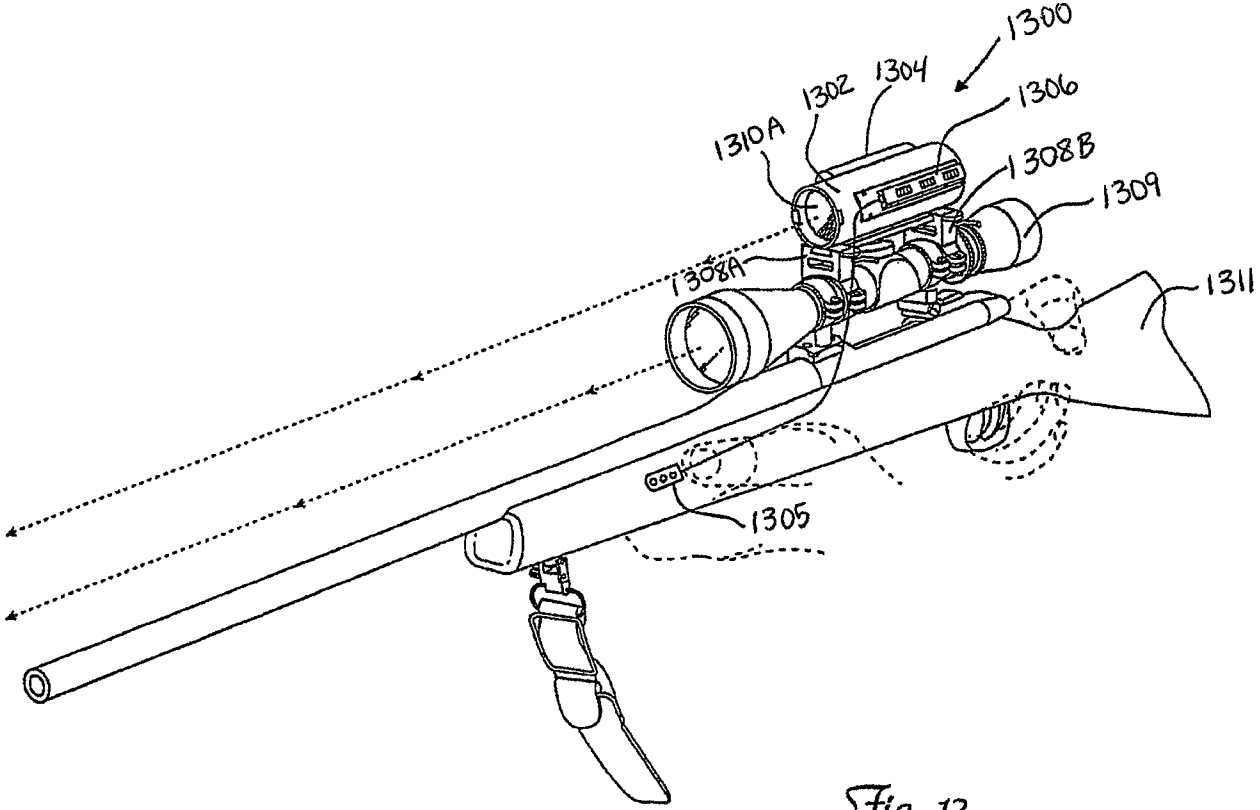
FIG. 13 is a perspective view of a rangefinder of another embodiment of the present invention mounted to a firearm.

Referring to FIG. 13, a rangefinder 1300 of another embodiment of the present invention is illustrated. As illustrated, the range finder 1300 includes a main housing 1302 and a power supply housing 1304. The main housing 1302 encases signal lens 1310A through which a radar signal is passed and received. Also illustrated in FIG. 13, is an operation panel 1306 that is used to operate the range finder 1300. The range finder 1300 can also be operated by a remote unit 1305. In particular, the remote unit 1305 is adapted to be attached to a firearm in such a manner that it allows easy manipulation of the range finder 1300. This feature is illustrated in FIG. 13. The range finder 1300 in this embodiment is adapted to be mounted to a scope 1309 that is in turn mounted to firearm 1311. Moreover, in this embodiment the range finder 1300 is mounted to the scope 1309 with mounting brackets 1308A and 1308B.

Figure 14:
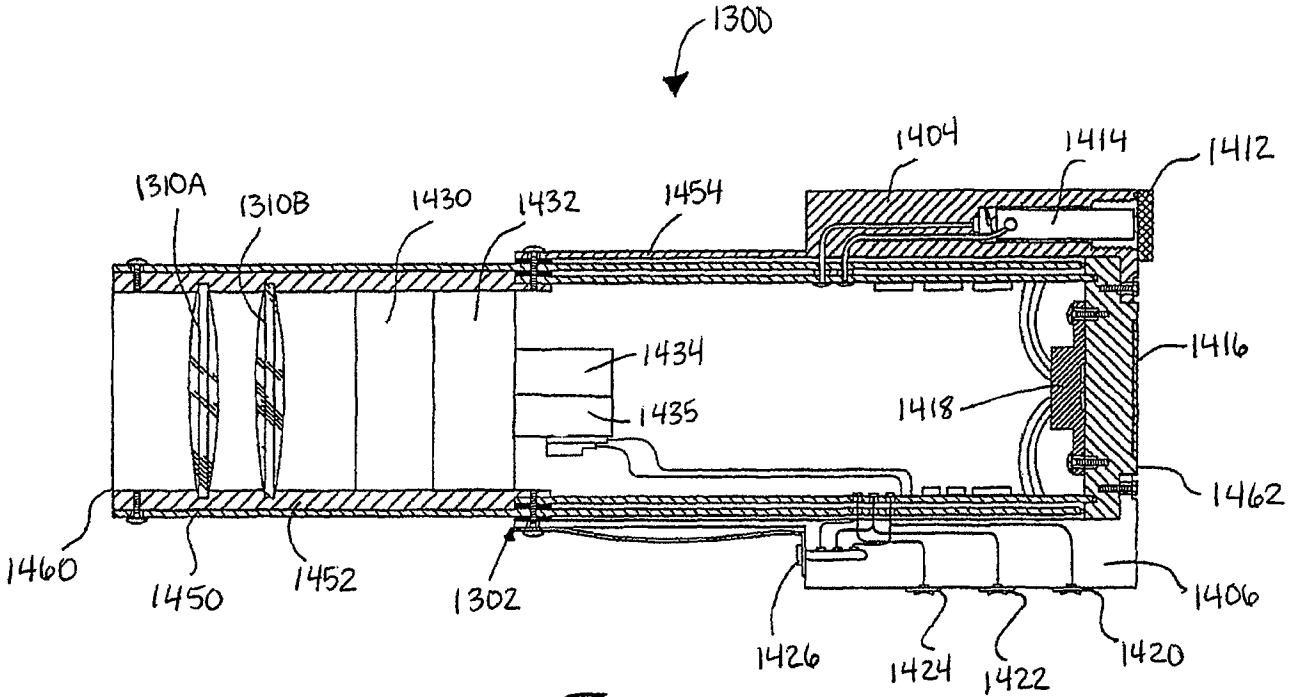
FIG. 14 is a cross-sectional view of the rangefinder of FIG. 13.

Referring to FIG. 14 a cross-sectional top view of the range finder 1300 is illustrated. As illustrated, the main housing 1302 includes a first section 1450 and a second section 1454. The first and second sections 1450 and 1454 are connected by a plurality of attaching screws. In other embodiments, other attaching means are used and this invention is not limited to the use of attaching screws. As illustrated, an inter attachment section 1452 abuts the first section 1450. The inter attachment section 1450 is adapted to hold a first and second signal lens 1310A and 1310B. Although, this embodiment uses two signal lenses 1310A and 1310B, it will be understood in the art that other signal focusing method and other projection methods could be used and that this invention is not limited to two signal lenses 1310A and 1310B. Also illustrated are signal generation circuit 1430, signal receiving circuit 1432, a process circuit 1434 and a control circuit 1435 that make up part of a range finding circuit. The signal generation circuit 1430 is adapted to generate a signal that is projected out of the signal end 1460 of the range finder 1300. The signal receiving circuit 1432 is adapted to receive signals reflected off of an object and reflected back through the signal end 1460 of the range finder 1300. The process circuit 1434 is adapted to process the received signals to determine the distance to the object the signal was reflected off of. The control circuit 1435 is adapted to control and synchronize the signal generation circuit 1430, the signal receiving circuit 1432 and the process circuit 1434 based on operating signals provided by a user. In one embodiment, a signal propagation time measuring method is used to determine the distance to an object. In other embodiments, a light-section method or a binocular sterosis method or other similar methods are used. Accordingly, the present invention is not limited to a specific type of method of determining distances to an object.

Further illustrated in FIG. 14, is the power supply housing 1404 in the second section 1454 of the range finder 1300. In this embodiment, the power supply 1414 is a battery that is received in a cavity of the power supply housing 1404. The power supply 1414 is retained in the power supply housing 1404 with a threaded cap 1412. In this embodiment, the display 1416 is coupled to the display end 1462 of the range finder 1300. The display 1416 is adapted to display indicia that represents the distance to an object when the range finder 1300 is activated. In one embodiment the display is an LCD. A display circuit 1418 is used to process signals from the processing circuit 1434 and to direct the display 1416 to display the distance. The control circuit 1425 is controlled by operating switches 1420, 1422 and 1424 on the operating panel 1406 and alternately through the jack 1426 which is selectively coupled to the remote unit 1305. The control switches may include an on/off switch 1424, an activation switch 1420, a brightness control switch 1422 and the like. In one embodiment, the switches are activation buttons 1420, 1422 and 1424. As illustrated, the operating switches 1420, 1422 and 1424 are connected to control the control circuit 1425.

Figure 15:
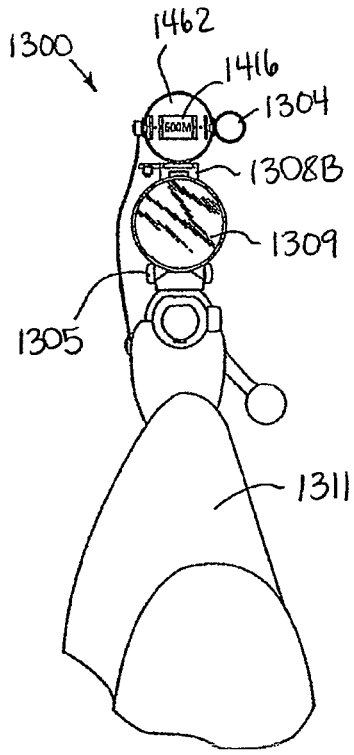
FIG. 15 is a rear view of the rangefinder coupled to a firearm of FIG. 13.

FIG. 15 illustrates a rear view of the range finder 1300 coupled to a firearm 1311. As illustrated, the range finder 1300 includes the display 1416 which is located on the display end 1462. In one embodiment, the display 1416 is encased in the display end 1462 of range finder 1300. In another embodiment, the display 1416 extends from the display end 1462 of the range finder 1300.

Figure 16:
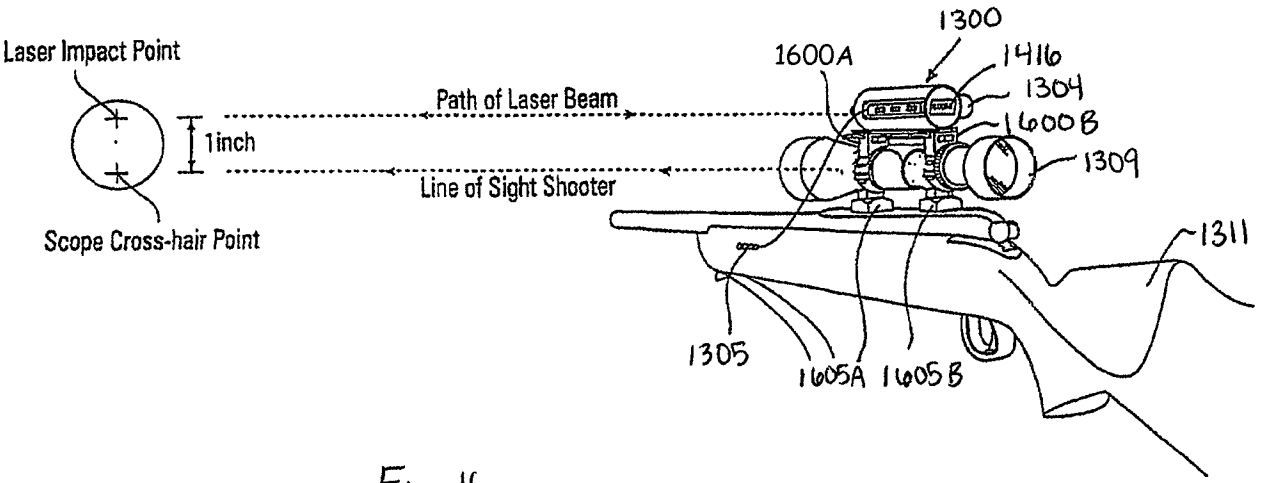
FIG. 16 is a perspective view the rangefinder coupled to a firearm of FIG. 13.

FIG. 16, is another perspective of the range finder 1300 of the present invention. FIG. 16, illustrates the path of the beam or signal and the line of sight provided by the scope 109. In this embodiment, the mounting brackets 1600A and 1600B of the range finder 1300 are integrated with the mounting brackets 1605A and 1605B that mount the scope 1309 to the firearm 1311. Mounting brackets 1605A and 1605B can be referred to as the receiver of the scope. Accordingly, in some embodiments of the present invention, the mounting mechanism of the scope is used to mount the range finder 1300 to the scope 1309. Further in some embodiments of the present invention where the range finder 1300 is directly mounted to a scope mount, a scope 1309 need not be present. This embodiment is especially useful for individuals who have eye problems or disabilities that do not allow them to use a scope 1039. Further in this embodiment, when the scope 1309 is not attached, the user can simply use the iron sights on the firearm to aim through the scope ring of the scope mounting brackets 1605A, 1605B.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An apparatus comprising:
a weapon;
a sight attached to the weapon;
a mount connected to the weapon; and
a range finder connected to the mount and mounted over the sight, the range finder comprising:
a housing having a front end, a rear end, and a bottom surface extending between the front end and the rear end;
a remote control pad electronically connected to the range finder for operating the range finder remotely;
a first threaded attaching aperture associated with the housing; and
a stabilizing recess associated with the housing; and
wherein the mount is attached to the housing, and the mount comprises:
a stabilizing nub that is inserted into the stabilizing recess;
a first rail aperture extending through the mount; and
a first mounting screw extending through the first rail aperture of the mount into the first threaded attaching aperture associated with the housing, thereby securing the housing to the mount.

2. The apparatus of claim 1,
wherein the remote control pad is attached to the weapon away from the housing of the range finder.

3. The apparatus of claim 1, wherein a line-of-sight from the sight is substantially parallel to a path of a laser beam emitted by the range finder.

4. The apparatus of claim 1, and further comprising:
a lens located at the front end of the housing.

5. The apparatus of claim 1, and further comprising:
a display located at the rear end of the housing.

6. The apparatus of claim 1, and further comprising:
a second threaded attaching aperture extending upwardly and associated with the bottom surface of the housing;
a second rail aperture extending through the mount; and
a second mounting screw that extends upwardly through the second rail aperture into the second threaded attaching aperture.

7. The apparatus of claim 1, wherein the stabilizing recess extends upwardly and is associated with the bottom surface of the housing.

8. The apparatus of claim 1, wherein the range finder further comprises:
a battery compartment including a threaded cover.

9. The apparatus of claim 1, wherein the front end is attached to the housing by a plurality of housing screws.

10. A method comprising:
attaching a mount to a range finder; and
mounting the range finder with the mount onto a weapon such that a line-of-sight from a sight is substantially parallel to a path of a laser beam emitted by the range finder;
wherein the range finder comprises:
a housing having a front end, a rear end, and a bottom surface extending between the front end and the rear end;
a remote control pad electronically connected to the range finder for operating the range finder remotely;
a threaded attaching aperture associated with the housing; and
a stabilizing recess associated with the housing; and
wherein the mount is attached to the housing, and the mount comprises:
a stabilizing nub that is inserted into the stabilizing recess;
a rail aperture extending through the mount; and
a screw extending through the rail aperture of the mount into the threaded attaching aperture associated with the housing, thereby securing the housing to the mount.

11. The method of claim 10, and further comprising:
positioning the range finder over the sight.

12. The method of claim 10, and further comprising:
turning on the rangefinder using the remote control pad.

* * * * *